US009966084B2

(12) United States Patent
Shi et al.

(10) Patent No.: US 9,966,084 B2
(45) Date of Patent: May 8, 2018

(54) METHOD AND DEVICE FOR ACHIEVING OBJECT AUDIO RECORDING AND ELECTRONIC APPARATUS

(71) Applicant: Xiaomi Inc., Beijing (CN)

(72) Inventors: Runyu Shi, Beijing (CN); Chiafu Yen, Beijing (CN); Hui Du, Beijing (CN)

(73) Assignee: Xiaomi Inc., Beijing, P.R. (CN)

( * ) Notice: Subject to any disclaimer, the term of this patent is extended or adjusted under 35 U.S.C. 154(b) by 0 days. days.

(21) Appl. No.: 15/213,150

(22) Filed: Jul. 18, 2016

(65) Prior Publication Data

US 2017/0047076 A1 Feb. 16, 2017

(30) Foreign Application Priority Data

Aug. 11, 2015 (CN) ..... 2015 1 0490373

(51) Int. Cl.
*G10L 19/20* (2013.01)
*G10L 19/16* (2013.01)
(Continued)

(52) U.S. Cl.
CPC ..... *G10L 19/20* (2013.01); *G10L 19/167* (2013.01); *H04S 3/008* (2013.01); *H04R 3/005* (2013.01);
(Continued)

(58) Field of Classification Search
CPC ..... G10L 19/20; G10L 19/167; H04R 3/005; H04S 3/008; H04S 2400/11; H04S 2400/15
See application file for complete search history.

(56) References Cited

U.S. PATENT DOCUMENTS 4,703,505 A 10/1987 Seiler et al.
7,035,418 B1 * 4/2006 Okuno ..... H04N 7/15 348/14.05
(Continued)

FOREIGN PATENT DOCUMENTS

CN 101129089 A 2/2008
CN 104429050 A 3/2015
(Continued)

OTHER PUBLICATIONS

Dolby Laboratories, Inc. "Dolby Atmos Next-Generation Audio for Cinema WHITE PAPER", 2014. http://www.dolby.com/us/en/technologies/dolby-atmos/dolby-atmos-next-generation-audio-for-cinema-white-paper.pdf.
(Continued)

*Primary Examiner* — Mark Fischer
(74) *Attorney, Agent, or Firm* — Brinks, Gilson & Lione

(57) ABSTRACT

A method and a device for achieving object audio recording and an electronic apparatus are disclosed. The method includes performing a sound collection operation via a plurality of microphones simultaneously to obtain a mixed sound signal. The method also includes identifying the number of sound sources and position information of each sound source and separating out an object sound signal corresponding to each sound source from the mixed sound signal according to the mixed sound signal and set position information of each microphone. The method further includes combining the position information and the object sound signal of individual sound sources to obtain audio data in an object audio format.

17 Claims, 7 Drawing Sheets

(51) Int. Cl.
*H04S 3/00* (2006.01)
*H04R 3/00* (2006.01)

(52) U.S. Cl.
CPC ..... *H04S 2400/11* (2013.01); *H04S 2400/15* (2013.01)

(56) References Cited

U.S. PATENT DOCUMENTS

| | | | | |
|---|---|---|---|---|
| 8,249,426 | B2 | 8/2012 | Kellock et al. | |
| 2011/0013075 | A1* | 1/2011 | Kim | H04N 5/602 348/370 |
| 2011/0144783 | A1 | 6/2011 | Reichelt et al. | |
| 2014/0133683 | A1 | 5/2014 | Robinson et al. | |
| 2014/0372107 | A1 | 12/2014 | Vilermo et al. | |

FOREIGN PATENT DOCUMENTS

| | | | |
|---|---|---|---|
| CN | 104581512 | A | 4/2015 |
| CN | 105070304 | A | 11/2015 |
| EP | 2 194 527 | A2 | 6/2010 |
| EP | 2 575 130 | A1 | 4/2013 |
| EP | 2 782 098 | A2 | 9/2014 |
| JP | 2008-532374 | A | 8/2008 |
| JP | 2008-294620 | A | 12/2008 |
| JP | 2012-042454 | A | 3/2012 |
| KR | 10-2010-0044991 | A | 5/2010 |
| KR | 10-2011-0019162 | A | 2/2011 |
| RU | 2 431 940 | C2 | 10/2011 |
| RU | 2 455 709 | C2 | 7/2012 |
| WO | WO 2011/020065 | A1 | 2/2011 |
| WO | WO 2014/106543 | A1 | 7/2014 |

OTHER PUBLICATIONS

Geometric High-Order Dicorrelation-Based Source Separation, http://winnie.kuis.kyoto-u.ac.jp/HARK/document/hark-document-en/subsec-GHDSS.html.

Griffiths, L.J., "*An Alternative Approach to Linearly Constrained Adaptive Beamforming*", IEEE Trans. Antennas and Propagation, vol. AP-30, No. 1, 1982, pp. 27-34.

ISO/IEC DIS 23008-3 "*Information technology—High efficiency coding and media delivery in heterogeneous environments*—Part 3:3D audio", http://mpeg.chiariglione.org/standards/mpeg-h/3d-audio/dis-mpeg-h-3d-audio.

Omologo, M., et al., "*Acoustic Event Localization, Using a Crosspower-Spectrum Phase Based Technique*," Acoustics, Speech, and Signal Processing, 1994. ICASSP-94., IEEE International Conference on, vol. II, pp. 11/273, 11/276, vol. 2, Apr. 1994, pp. 19-22.

Schmidt, R.O., "*Multiple Emitter Location and Signal Parameter Estimation*," IEEE Transactions on Antenna and Propagation, vol. AP-34, No. 3, 1986, pp. 276-280.

Extended European Search Report dated Mar. 2, 2017 for European Application No. 16160671.0, 13 pages.

International Search Report dated Apr. 12, 2016 for International Application No. PCT/CN2015/098847, 5 pages.

Odfield, Robert et al., "Object-Based Audio for Interactive Football Broadcast," Multimedia Tools and Applications, vol. 74, No. 8, 2013, pp. 2717-2741.

Office Action dated Dec. 27, 2016 for Korean Application No. 10-2016-7004592, 4 pages.

Office Action dated Jul. 12, 2017 for Russian Application No. 2016114554/08, 21 pages.

Ozerov, Alexey et al., "Multichannel Nonnegative Matrix Factorization in Convolutive Mixtures for Audio Source Separation," IEEE Transactions on Audio, Speech, and Language Processing, vol. 18, No. 3, 2010, pp. 550-563.

Partial European Search Report dated Jan. 19, 2017 for European Application No. 16160671.0, 8 pages.

Office Action dated Sep. 26, 2017 for Japanese Application No. 2017-533678, 4 pages.

Examination Report dated Feb. 15, 2018 for European Application No. 16160671.0, 7 pages.

Office Action dated Feb. 24, 2018 for Chinese Application No. 201510490373.6, 8 pages.

* cited by examiner

METHOD AND DEVICE FOR ACHIEVING OBJECT AUDIO RECORDING AND ELECTRONIC APPARATUS

PRIORITY STATEMENT

This application is based upon and claims priority to Chinese Patent Application 201510490373.6, filed Aug. 11, 2015, the entire contents of which are incorporated herein by reference.

TECHNICAL FIELD

The present disclosure generally relates to technical field of recording, and more particularly, to methods, devices, and electronic apparatuses for achieving object audio recording.

BACKGROUND

In February of 2015, a new generation of audio codec standard MPEG-H 3D Audio of MPEG (Moving Picture Experts Group) officially became ISO/IEC 23008-3 international standard. Under this standard framework, a bran-new audio format—object-based audio (object audio) is adopted. The object audio represents the sound as separate elements (e.g. singer, drums), and adds positional information to them, so they can be rendered to be played out from the correct location. With the object audio, an orientation of sound may be identified, such that a listener may hear a sound came from a specific orientation, no matter if the listener is using an earphone or a stereo, and no matter how many loudspeakers the stereo has. MPEG-H 3D is not the only audio codec that has adopted object audio. For example, the next generation audio codec from Dolby, the Dolby Atmos, is based on object audio. Auro-3D, as another example, also uses object audio.

SUMMARY

The present disclosure provides a method and a device for achieving object audio recording and an electronic apparatus.

According to an aspect of the present application may include: collecting, by an electronic device, a mixed sound signal from a plurality of sound sources simultaneously via a plurality of microphones; identifying, by the electronic device from the mixed sound signal, each of the plurality of sound sources and position information of each sound source; for each of the plurality of sound sources, separating out, by the electronic device, an object sound signal from the mixed sound signal according to the position information of the sound source; and combining the position information and the object sound signals of each of the plurality of sound sources to obtain audio data of the mixed sound signal in an object audio format.

According to another aspect of the present application, an electronic apparatus may include a memory for storing instructions executable by the processor; and a processor in communication with the memory. When executing the instructions, the processor is configured to: collect a mixed sound signal from a plurality of sound sources simultaneously via a plurality of microphones; identify, from the mixed sound signal, each of the plurality of sound sources and position information of each sound source; for each of the plurality of sound sources, separate out an object sound signal from the mixed sound signal the position information of the sound source; and combine the position information and the object sound signals of each of the plurality of sound sources to obtain audio data of the mixed sound signal in an object audio format.

According to yet another aspect of the present application, a non-transitory readable storage medium may include instructions executable by a processor in an electronic apparatus for achieving object audio recording. When executed by the processor, the instructions may direct the electronic apparatus to perform acts: collecting, by an electronic device, a mixed sound signal from a plurality of sound sources simultaneously via a plurality of microphones; identifying, by the electronic device from the mixed sound signal, each of the plurality of sound sources and position information of each sound source; for each of the plurality of sound sources, separating out, by the electronic device, an object sound signal from the mixed sound signal according to the position information of the sound source; and combining the position information and the object sound signals of each of the plurality of sound sources to obtain audio data of the mixed sound signal in an object audio format.

It is to be understood that both the foregoing general description and the following detailed description are exemplary and explanatory only and are not restrictive of the present disclosure, as claimed.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

In the related art, it is incapable of obtaining object audio via direct recording. For convenient of understanding, typical processing modes in the related art are introduced below.

Figure 1:
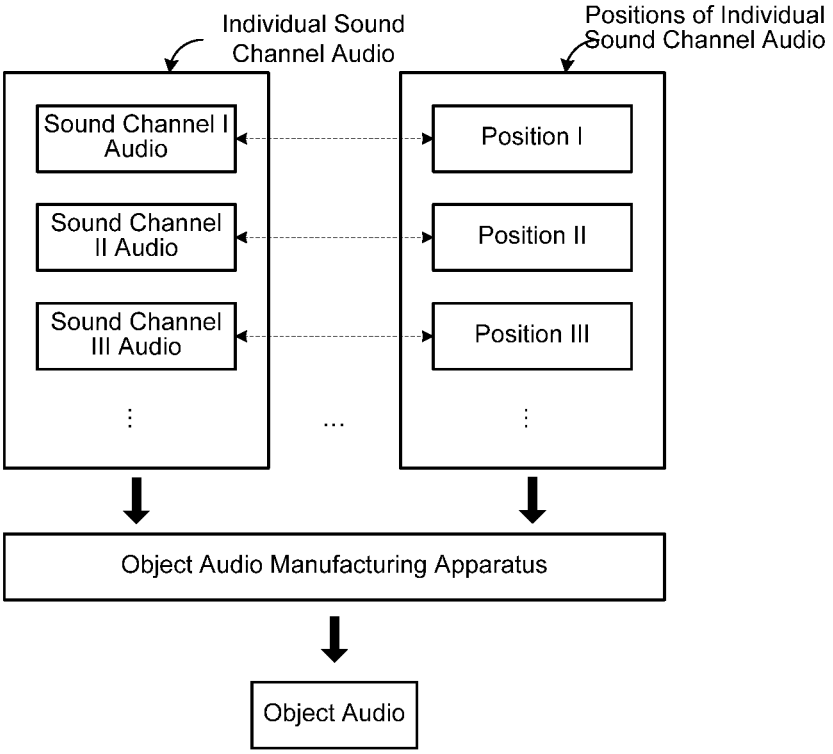
Fig.1 (Prior Art)
FIG. 1 is a schematic diagram of acquiring an object audio in the related art.

FIG. 1 is a schematic diagram of acquiring an object audio in the related art. As show in FIG. 1, during the process, a plurality of mono audios need to be prepared in advance, such as a sound channel I audio, a sound channel II audio, and a sound channel III audio in FIG. 1. In the meanwhile, position information corresponding to each mono audio needs to be prepared in advance, such as a position I corresponding to the sound channel I audio, a position II corresponding to the sound channel II audio, and a position III corresponding to the sound channel III audio. Finally, each sound channel audio is combined with the corresponding position via an object audio manufacturing apparatus, so as to obtain an object audio.

However, the following deficiencies exist in the processing manner shown in FIG. 1.

1) The audio data and the position information need to be prepared in advance, thereby the object audio cannot be obtained via a direct recording.

2) Further, the positions of respective sound channel audio are prepared and obtained independently, thereby the real position of each sound channel audio often cannot be reflected accurately.

Figure 2:
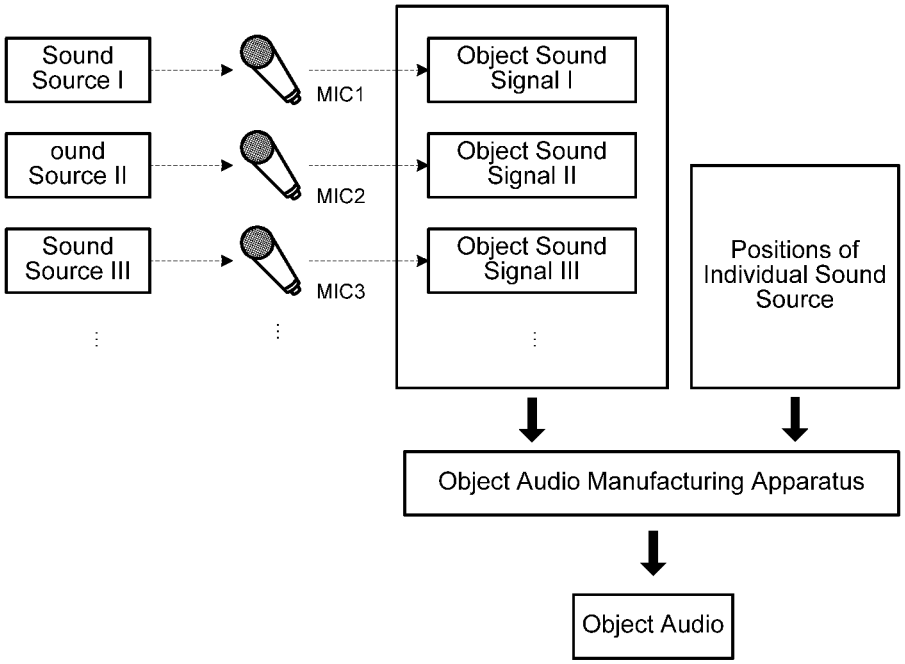
Fig.2 (Prior Art)
FIG. 2 is another schematic diagram of acquiring an object audio in the related art.

FIG. 2 is another schematic diagram of acquiring an object audio in the related art. As shown in FIG. 2, a corresponding MIC (microphone) is prepared for each sound source, for example, a sound source I corresponds to a MIC1, a sound source II corresponds to a MIC2, and a sound source III corresponds to a MIC3. Each MIC only collects the corresponding sound source, and obtains corresponding object sound signal I, object sound signal II and object sound signal III. Meanwhile, position information of each sound source needs to be prepared in advance. Finally, the object sound signals and the position information corresponding to individual sound sources are combined via an object audio manufacturing apparatus, so as to obtain an object audio.

However, the following deficiencies exist in the processing manner shown in FIG. 2.

1) Each sound source needs to be provided a MIC separately, thereby the hardware cost is high.

2) Since the MIC must be close to the sound source, and move with the sound source, the implementation is very difficult, and the cost of the recording equipment will greatly increase.

3) Synchronization needs to be kept among the object sound signals respectively collected by the plurality of MICs. In cases where the number of the sound sources is large and the MICs are close to the sound source and away from the object audio manufacturing apparatus, or in case where wireless MICs are utilized, the implementation is very difficult.

4) Since the position information of the sound source are separately obtained and then added into the object audio at the later period, under the influence of relatively more sound sources and irregular movement, the finally obtained object audio will hardly be true to the actual sound source position.

Thereby, the present disclosure provides technical solutions of achieving recording of object audio, and may solve the above-mentioned technical problems existing in the related art.

Figure 3:
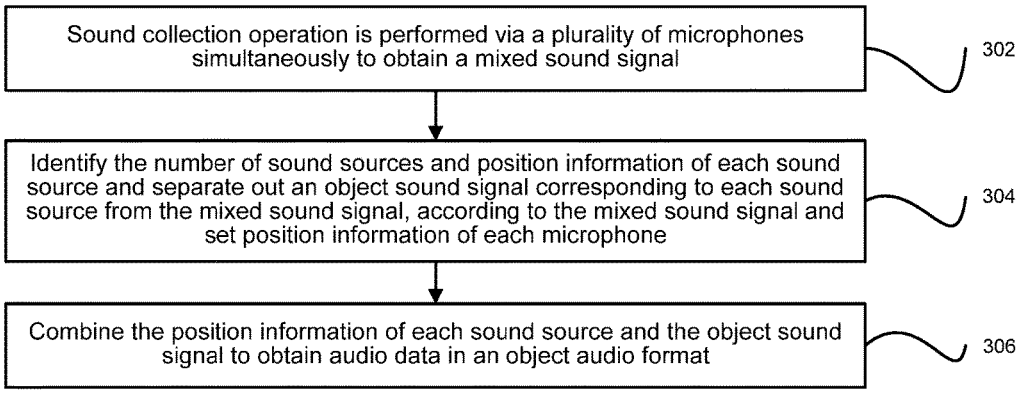
FIG. 3 is a flow chart of a method for recording an object audio, according to an exemplary embodiment of the present disclosure.

FIG. 3 is a flow chart of a method for recording an object audio, according to an exemplary embodiment. As shown in FIG. 3, the method is applied in a recording apparatus, and may include the following steps.

In step 302, simultaneously obtaining a mixed sound signal by performing a sound collection operation via a plurality of microphones.

In step 304, identifying a number of sound sources and position information of each sound source and separating out an object sound signal corresponding to each sound source from the mixed sound signal, according to the mixed sound signal and set position information of each microphone.

As an illustrative embodiment, the number of sound sources and position information of each sound source may be identified and the object sound signal corresponding to each sound source may be separated out from the mixed sound signal directly according to characteristic information, such as an amplitude difference, spectral characteristics, and a phase difference formed among respective microphones by a sound signal emitted by each sound source, as will be described in more details below.

As another illustrative embodiment, the number of sound sources and position information of each sound source may be first identified from the mixed sound signal according to the characteristic information such as the above-mentioned amplitude difference and phase difference, based on the mixed sound signal and the set position information of each microphone; and then the object sound signal corresponding to each sound source may be separated out from the mixed sound signal, according to the characteristic information such as the above-mentioned amplitude difference and phase difference, based on the mixed sound signal and the set position information of each microphone.

In step 306, combining the position information of each sound source and the object sound signal to obtain audio data in an object audio format.

In the present embodiment, the object audio may be a sound format for describing an audio object in general. For example, the audio object may be a point sound source that may include position information; the audio object may also be an area sound source (an area serving as a sound source) whose central position may be roughly identified.

In the present embodiment, the object audio may include two portions: position of sound source and object sound signal, wherein the object sound signal per se may be deemed as a mono audio signal, a form of the object sound signal may be an uncompressed format such as a PCM (Pulse-code modulation) and a DSD (Direct Stream Digital), or may be a compressed format such as MP3 (MPEG-1 or MPEG-2 Audio Layer III), AAC (Advanced Audio Coding), and Dolby Digital, which is not limited by the present disclosure.

It can be known from the above embodiments, in the present disclosure, by setting a plurality of microphones and performing sound collection at the same time, the obtained mixed sound signal contains the sound signals collected by respective microphones, and by combining the set position information among respective microphones, each sound source is identified and a corresponding object sound signal is separated out without separately collecting the sound signal of each sound source, which reduces the dependency and requirement for the hardware apparatus, and audio data in the object audio format can be obtained directly.

Figure 4:
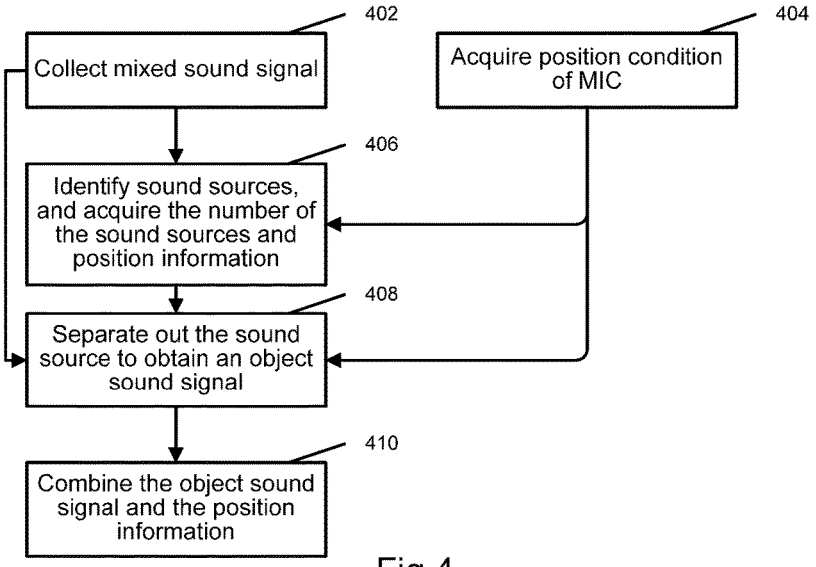
FIG. 4 is a flow chart of another method for recording an object audio, according to an exemplary embodiment of the present disclosure.

FIG. 4 is a flow chart of another method for recording an object audio, according to an exemplary embodiment of the present disclosure. The method may be implemented by a recording apparatus. As shown in FIG. 4, the method may include the following steps.

In step 402, obtaining a mixed sound signal by simultaneously collecting a sound via a plurality of MICs.

In the present embodiment, If the plurality of sound sources are in a same plane, then the recording apparatus may perform an object audio recording operation through 2 microphones; and if the plurality of sound sources are distributed in a 3D space (regularly or arbitrarily), the recording apparatus may perform the object audio recording operation through 3 or more microphones. For the same setting of sound sources (i.e., in the same plane or in the 3D space), the more the microphones are, the easier to identify the number and position information of the sound sources, and to separate the object sound signal of each sound source.

In step 404, obtaining position information of each MIC.

Figure 5:
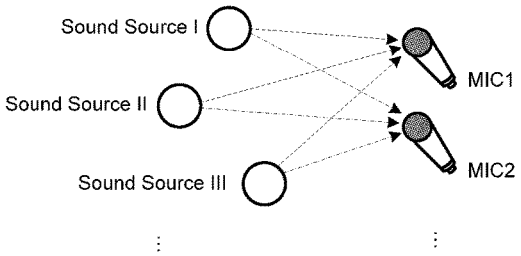
FIG. 5 is a schematic diagram of collecting a sound source signal, according to an exemplary embodiment of the present disclosure.

In the present embodiment, as shown in FIG. 5, during recording of object audio by each MIC, the position information of each MIC remains unchanged. Even if the position information of the sound source changes, the MIC needs not to change its position information, since the change in position may be embodied in the collected mixed sound signal, and may be identified by the subsequent steps. Meanwhile, there is not a one-to-one correspondence between the MICs and the sound sources. No matter how many sound sources there are, sound signal collection may be performed via at least two or three MICs (depending on the whether the sound source is in a 2D plane or 3D space), and corresponding mixed sound signals may be obtained.

Thereby, compared with the embodiments shown in FIG. 1 and FIG. 2, the present embodiment can identify actual position of each sound source accurately without many MICs, and without synchronous movement of MIC along with the sound source, which facilitates reducing cost of the hardware and complexity of the system, and improving the quality of the object audio.

In the present embodiment, the position information of the MIC may include: set position information of the MIC. The position information of each MIC may be recorded by using coordinates, for example, space coordinates using any position (such as a position of an audience) as an origin, such space coordinates may be rectangular coordinates (O-xyz), or spherical coordinates (O-θγr), and a conversion relationship between these two coordinates is as follows:

$$\begin{bmatrix} x \\ y \\ z \end{bmatrix} = \begin{bmatrix} \cos(\theta) * \cos(\gamma) * r \\ \sin(\theta) * \cos(\gamma) * r \\ \sin(\gamma) * r \end{bmatrix}$$

wherein, x, y, and z respectively indicate position coordinates of the MIC or the sound source (object) on a x axis (fore-and-aft direction), a y axis (left-right direction), and a z axis (above-below direction) in the rectangular coordinates; and θ, γ, and r respectively indicate a horizontal angle (an angle between a projection of a line connecting the MIC or the sound source and the origin in a horizontal plane and the x axis), a vertical angle (an angle between the line connecting the MIC or sound source and the origin and the horizontal plane) of the MIC or the sound source, and a straight-line distance of the MIC or the sound source from the origin, in the spherical coordinates.

Certainly, the position information of each MIC may be separately recorded; or relative position information among respective MICs may be recorded, and individual position information of each MIC may be deduced therefrom.

In step 406, according to the position information of each MIC, identifying an identity of each sound source from the mixed sound signal, and acquiring and/or obtaining the number of the sound sources and position information of each sound source.

As an exemplary embodiment, the number of the sound sources and the position information of each sound source may be identified based on an amplitude difference and a phase difference formed among respective microphones by the sound signal emitted by each sound source. In the present embodiment, the corresponding phase difference may be embodied by a difference among the time at which the sound signal emitted by each sound source arrives at respective microphones, as will be shown below.

In practice, all the technical solutions of identifying the sound source (determining whether the sound source exists) and identifying the number of the sound sources and the position information based on the amplitude difference and the phase difference in the related art may be applied in the process of the step 406, such as MUSIC (Multiple Signal Classification) method, Beamforming method, and CSP (crosspower-spectrum phase) method. For example, MUSIC can be used to estimate angle of arriving in array signal processing in noisy environment. In CPS, the idea is that the angle of arrival can be derived through the time delay of arrival between microphones. The time delay of arrival can be estimated by determining the maximum coefficient of CSP.

Certainly, there are other algorithms of identifying the number of the sound sources and the position information based on the amplitude difference and the phase difference in the related art, and there are algorithms based on other principles for identifying the number of the sound sources and the position information in the related art, all of which may be applied in the embodiments of the present disclosure, and which is not restricted by the present disclosure.

In step 408, separating off and/or isolating an object sound signal corresponding to each sound source from the mixed sound signal according to the position information of each MIC, the number of the sound sources, and the position information of each sound source.

As an exemplary embodiment, the object sound signal corresponding to each sound source may be isolated and/or separated off based on the amplitude difference and the phase difference formed among respective microphones by the sound signal emitted by each sound source, for example, the Beamforming method used at the receiving ends, and the GHDSS (Geometric High-order Decorrelation-based Source Separation) method may be used to implement the above separation. Beamforming is based on destructive and constructive pattern at the microphones. GHDSS performs higher-order decorrelations between sound source signal and directivibity formation towards the sound source direction. For GHDSS, the positional relation of the microphones is used as a geometric constraint.

In another exemplary embodiment, because sound signal from each sound source may form a characteristic quantity under a preset dimension, the recording apparatus may establish and/or implement a corresponding statistical model according to the characteristic quantity of each sound signals. Via the statistic model, the recording apparatus may identify and isolate and/or separate off any sound signal that conforms to the position information of any individual sound source from the mixed sound signal. The isolated sound signal may then be treated and used as the object sound signal corresponding to the individual sound source. The statistical model may adopt any characteristic quantities in all available dimensions, such as a spectrum difference, a volume difference, a phase difference, a base frequency difference, a base frequency energy difference, and a resonance peak, all of which can be used herein. The principle of this embodiment lies in: identifying whether a certain sound signal belongs to a certain specific sound field via the statistical model (i.e., the inferred sound source position). For example, the algorithms such as GMM (Gaussian Mixture Model) may be used to achieve the above process. In particular, statistical feature sets such as spectral, temporal, or pitch-based features from sound of various sources and directions are first classified based on learning from training data. The trained model is then used to estimate sources in a sound signal and their locations.

Certainly, there are other algorithms of separating out the object sound signal based on the amplitude difference and the phase difference or the statistical model in the related art, and there are algorithms based on other principles for separating out the object sound signal in the related art, all of which may be applied in the embodiments of the present disclosure, and which is not restricted by the present disclosure.

In the above exemplary embodiments in FIG. 4, steps 406 and 408 are respectively described. Under some conditions, the process for implementing steps 406 and 408 needs to be respectively implemented indeed. However, under some other conditions such as based on the above principles of Beamforming, the recognition of the number of the sound sources and the position information and the separation of the object sound signal of each sound signal may be achieved at the same time without conducting the above two steps processing.

In step 410, combining the object sound signal and the position information of each individual sound source to obtain an object audio of that individual sound source.

Figure 6:
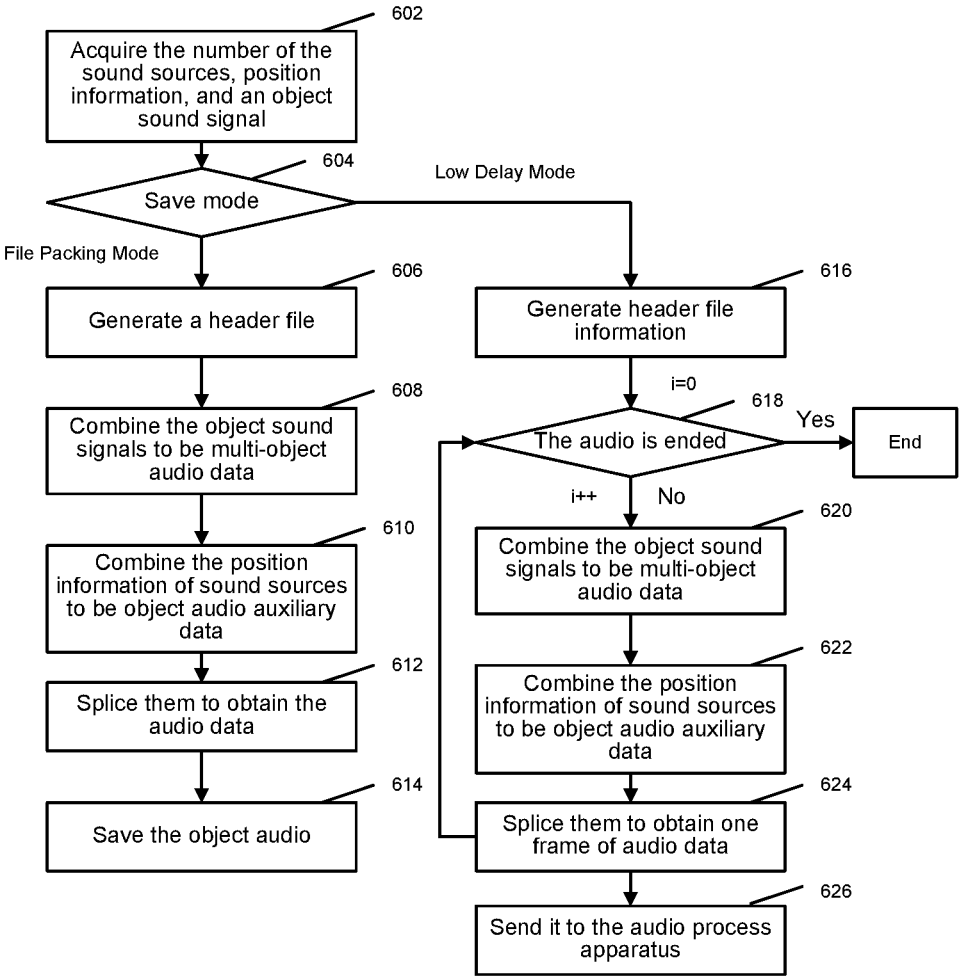
FIG. 6 is a flow chart of further another method for recording an object audio, according to an exemplary embodiment of the present disclosure.

With respect to the combination operation in step 410, the detail description will be given below in combination with FIG. 6. FIG. 6 is a flow chart of another method for recording an object audio, according to an exemplary embodiment of the present disclosure. The method may be implemented by a recording apparatus. As shown in FIG. 6, the method may include the following steps.

In step 602, acquiring the number of the sound sources, position information of each sound source, and an object sound signal of each sound source.

In step 604, determining a save mode selected by a user. If the save mode is a File Packing Mode, the process switches to step 606; and if the save mode is a Low Delay Mode, the process switches to step 616.

1. File Packing Mode

In step 606, a header file is generated.

In the present embodiment, the header file contains predefined parameters describing the object audio, such as ID information, and a version number. As an exemplary embodiment, a format and content of the header file are shown in Table 1.

TABLE 1

| Parameter name | Bits | Mnemonic | Content |
|---|---|---|---|
| ID | 32 | bslbf | OAFF (Object audio ID) |
| Version | 16 | uimsbf | 1.0 (Version number of object audio) |
| nObjects | 16 | uimsbf | n (Number of sound sources) |
| nSamplesPerSec | 32 | uimsbf | a (sampling frequency) |
| wBitsPerSample | 16 | uimsbf | w (byte length of each sampling) |

In step 608, combining corresponding object sound signals according to an arrangement order of individual sound sources so as to obtain a multi-object audio data. The arrangement order of individual sound may be any chosen order among the sources. Because the sound signal and the position information of the sources are separate in the combined object audio, some chosen order is maintained such that the sound signal and the position information each is organized in the same order with respect to the sources.

In the present embodiment, the procedure of combining the object sound signals may include:

1) sampling an object sound signal corresponding to each sound source at each sampling time according to a preset sampling frequency, and arranging all the sampled signals according to the arrangement order, so as to obtain a combined sampled signal; and 2) arranging the combined sampled signals obtained at each sampling time point in turn according to the sampling order, so as to obtain the multi-object audio data.

The sampling at the preset sampling frequency may be performed on analog signal if the separated sound signal from a source is analog. Even if the separated signal from a source is digital already, it may still need to be resampled according to the preset sampling frequency and byte length as specified in the header file since the original sampling frequency and/or byte length of the source may not match the preset sampling frequency and/or byte length in the header file.

Figure 7:
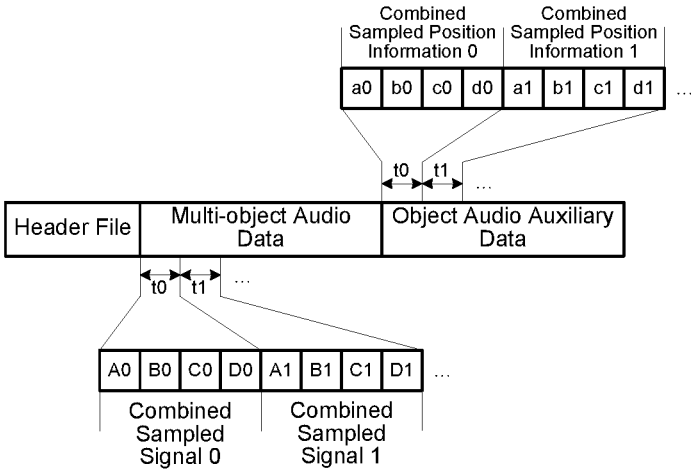
FIG. 7 is schematic diagram of a frame structure of an object audio, according to an exemplary embodiment of the present disclosure.

For example, as shown in FIG. 7, in a data structure of an object audio in an exemplary embodiment, t0, t1 and the like are individual sampling time points corresponding to the preset sampling frequency. Taking the sampling time point t0 as an example, assuming that there are total of 4 sound sources A, B, C and D, and the arrangement order of the respective sound sources is, for example, A→B→C→D (any other order may be chosen), then at time t0, the recording apparatus may obtain a sampled signal A0 from sound source A, a sampled signal B0 from sound source B, a sampled signal C0 from sound source C, and a sampled signal D0 from sound source D by sampling the four sound sources according to the arrangement order A→B→C→D. The recording apparatus then may generate a corresponding combined sampled signal 0 by combining A0, B0, C0, and D0. Similarly, by sampling in the same manner at sampling time point t1, the recording apparatus may obtain the combined sampled signal 1. In other words, at each sampling time point, the recording apparatus may respectively obtain a combined sampled signal 0, and a combined sampled signal 1 corresponding to each sampling time point t0 and t1. Finally, the multi-object audio data may be obtained by arranging them according to the corresponding sampling sequence of respective combined sampled signals, i.e., the recording apparatus may arrange the combined sampled signal 0 and combined sampled signal 1 according to the sampling sequence t0, t1 to obtain the multi-object audio data.

In step 610, combining the position of each individual sound source according to the arrangement order of individual sound sources so as to obtain object audio auxiliary data.

As an exemplary embodiment, the procedure of combining the object sound signals may include:

1) sampling position information corresponding to each sound source at each sampling time point according to a preset sampling frequency, and recording each sampled position information in association with corresponding sound source information and the sampling time point information, so as to obtain combined sampled position information; and 2) in turn arranging the combined sampled position information obtained at each sampling time point according to the sampling order, so as to obtain the object auxiliary audio data In an implementation manner, the generation procedure of the object audio auxiliary data is similar to that of the multi-object audio data. Still taking FIG. 7 as an example, for the sampling time point t0, assuming that there are total of 4 sound sources A, B, C and D, and the arrangement order of the respective sound sources is, for example, A→B→C→D (such that the order matches that in the multi-object audio data above), then the recording apparatus may sample the position information of the 4 sound sources one by one according to this arrangement order A→B→C→D. The obtained sampling result, respectively, are sampled position information a0, sampled position information b0, sampled position information c0, and sampled position information d0. With these sampled position information, the recording apparatus may generate the corresponding combined sampled position information 0. Similarly, at time t1, the recording apparatus may obtain the combined sampled position information 1 in the same manner. Therefore, by sampling in the same manner at each sampling time point, the recording apparatus may obtain the combined sampled position information 0, and combined sampled position information 1 respectively corresponding to each sampling time point t0 and t1. Finally, the object audio auxiliary data may be obtained by arranging them according to the sampling sequence corresponding to respective combined sampled position information.

In the present embodiment, the position information of all the sound sources at all the sampling time point are recorded in the object audio auxiliary data; however, since the sound sources do not move all the time, the data amount of the object audio auxiliary data may be reduced by differentially record the position information of the sound sources. The manner of differential record is explained by the following implementation manner.

As another exemplary embodiment, the procedure of combining the object sound signals may include: sampling position information corresponding to each sound source according to a preset sampling frequency; wherein if a current sampling point is a first sampling time point, the obtained each sampled position information is recorded in association with the corresponding sound source information and the sampling time point information; and if the current sampling point is not the first sampling time point, the obtained each sampled position information is compared with previous sampled position information of the same sound source which has been recorded, and when the comparison result is that they are different, the sampled position information is recorded in association with the corresponding sound source information and the sampling time point information.

Figure 8:
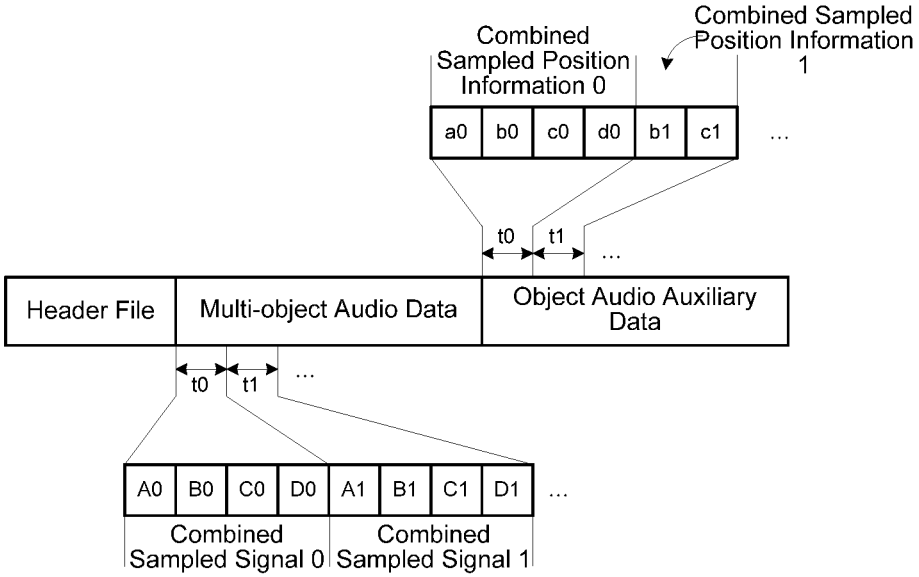
FIG. 8 is schematic diagram of another frame structure of an object audio, according to an exemplary embodiment of the present disclosure.

For example, as shown in FIG. 8, assuming that there are total of 4 sound sources A, B, C and D, and the arrangement order of the respective sound sources are chosen to be A→B→C→D, then for the sampling time point t0, since the sampling time point t0 is the first sampling time point, the position information of the 4 sound sources are sampled in turn (one after another) according to the implementation manner shown in FIG. 7 so as to obtain a combined sampled position information 0 constituted by the sampled position information a0, the sampled position information b0, the sampled position information c0, and the sampled position information d0.

For other sampling time points in addition to t0, such as the sampling time point t1, although the position information of 4 sound sources may be sampled in turn to obtain the corresponding sampled position information a1, sampled position information b1, sampled position information c1, and sampled position information d1, if the sampled position information a1 corresponding to the sound source A is the same as the previous sampled position information a0, it is unnecessary to record the sampled position information a1. Therefore, if the sampled position information a1 is the same as the sampled position information a0, the sampled position information d1 is the same as the sampled position information d0, the sampled position information b1 is different from the sampled position information b0, and the sampled position information c1 is different from the sampled position information c0, then the final combined sampled position information 1 corresponding to the sampling time point t1 may only include the sampled position information b1 and the sampled position information c1.

In step 612, splicing, in turn, header file, the multi-object audio data and the object audio auxiliary data so as to obtain and/or form the audio data in the object audio format.

In the present embodiment, as shown in FIGS. 7-8, the audio data in the object audio format may include the header file, the multi-object audio data and the object audio auxiliary data which are spliced in turn. When broadcasting the audio data, descriptor and parameter of the audio data may be read via the header file, then the combined sampled signal corresponding to each sampling time point is exacted in turn from the multi-object audio data, and the combined sampled position information corresponding to each sampling time point is exacted in turn from the object audio auxiliary data. In this way, the corresponding broadcasting operation is achieved.

In step 614, saving the obtained object audio.

2. Low Delay Mode

In step 616, generating header file information containing a preset parameter and sending the header file information to a preset audio process apparatus, wherein the header file information may include a time length of each frame of audio data.

In the present embodiment, similar to the File Packing Mode, the header file contains predefined parameters describing the object audio, such as ID information, and a version number. Meanwhile, different from the File Packing Mode, the header file also contains a time length of each frame of audio data. In the present embodiment, a time length of each frame of audio data is predefined and recorded, thereby during generation of the object audio, the entire object audio is divided into several parts in a unit of the time length of each frame of the audio data, then each part of the object audio segment is sent to the audio process apparatus so as to be broadcasted in real time or to be stored by the audio process apparatus. In this way, the characteristics of low delay and high real-time performance are embodied.

As an exemplary embodiment, a format and content of the header file are shown in Table 2.

TABLE 2

| Parameter name | Bits | Mnemonic | Content |
|---|---|---|---|
| ID | 32 | bslbf | OAFF (Object audio ID) |
| Version | 16 | uimsbf | 1.0 (Version number of object audio) |
| nObjects | 16 | uimsbf | n (Number of sound sources) |
| nSamplesPerSec | 32 | uimsbf | a (sampling frequency) |
| wBitsPerSample | 16 | uimsbf | w (byte length of each sampling) |
| nSamplesPerFrame | 16 | uimsbf | B (length of each frame) |

In step 618, counting the frames having been processed by using the parameter i, and an initial value of the parameter i is set as i=0. If the process moves to step 618 and all the audio data have been processed completed, then the process ends; and if there are audio data having not been processed yet, the value of the parameter i is added by 1, and the process moves to step 620.

In the under-mentioned steps 620-622, the recording apparatus may process only data in the frame corresponding to the value of the parameter i, and the process manner is the same with the above-mentioned steps 608-610, which is not elaborated herein.

In step 624, splicing the multi-object audio data in the frame obtained in step 620 and the object audio auxiliary data in the frame obtained in step 622 so as to obtain one frame of audio data. Then, the procedure moves to step 618 to process a next frame, and moves to step 626 to process the audio.

In step 626, respectively sending the generated individual frames of the object audio to the audio process apparatus so as to be broadcasted in real time or to be stored.

Figure 9:
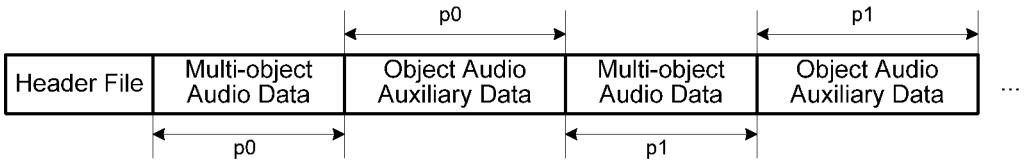
FIG. 9 is schematic diagram of further another frame structure of an object audio, according to an exemplary embodiment of the present disclosure.

Through the above embodiment, as shown in FIG. 9, in addition to the header file on the head, the rest part of the structure of the obtained object audio is partitioned into several frames, such as a first frame (p0 frame), and a second frame (p1 frame), and each frame may include the multi-object audio data and the object audio auxiliary data which are spliced correspondingly. Accordingly, when broadcasting the audio data, the audio process apparatus may read the descriptor and parameter of the audio data via the header file (including the time length of each frame of audio data), exact the multi-object audio data and the object audio auxiliary data from the received each frame of object audio in turn, and then exact the combined sampled signal corresponding to each sampling time point from the multi-object audio data in turn and exact the combined sampled position information corresponding to each sampling time point from the object audio auxiliary data in turn, so as to achieve the corresponding broadcasting operation.

Corresponding to the above-mentioned embodiments of the method for achieving object audio recording, the present disclosure also provides embodiments of a device for achieving object audio recording.

Figure 10:
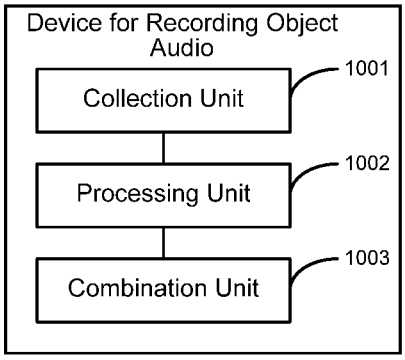
FIG. 10-FIG. 18 are block diagrams illustrating a device for recording an object audio, according to an exemplary embodiment of the present disclosure.

FIG. 10 is block diagram illustrating a device for recording an object audio, according to an exemplary embodiment. With reference to FIG. 10, the device may include a collection unit 1001, an processing unit 1002, a combination unit 1003.

The collection unit 1001 is configured to perform a sound collection operation via a plurality of microphones simultaneously so as to obtain a mixed sound signal.

The processing unit 1002 is configured to identify the number of sound sources and position information of each sound source and separate out an object sound signal corresponding to each sound source from the mixed sound signal according to the mixed sound signal and set position information of each microphone.

The combination unit 1003 is configured to combine the position information and the object sound signal of individual sound sources to obtain audio data in an object audio format.

Figure 11:
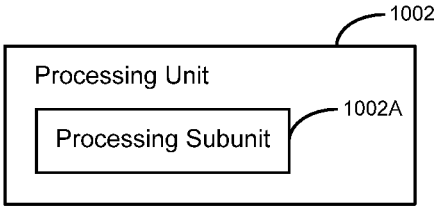

FIG. 11 is block diagram illustrating another device for recording an object audio, according to an exemplary embodiment. As shown in FIG. 11, on the basis of the embodiments shown in FIG. 10, the processing unit 1002 in the present embodiment may include a processing subunit 1002A.

The processing subunit 1002A is configured to identify the number of sound sources and position information of each sound source and separate out the object sound signal corresponding to each sound source from the mixed sound signal according to an amplitude difference and a phase difference formed among respective microphones by a sound signal emitted by each sound source.

Figure 12:
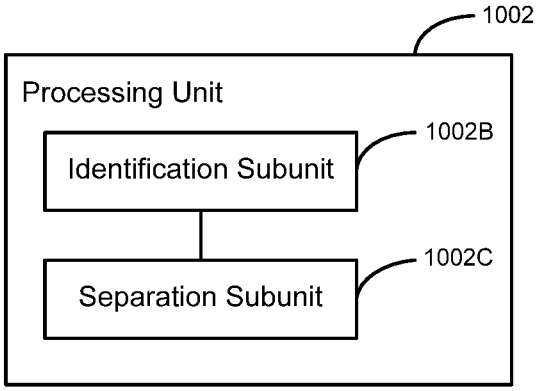

FIG. 12 is block diagram illustrating another device for recording an object audio, according to an exemplary embodiment. As shown in FIG. 12, on the basis of the embodiments shown in FIG. 10, the processing unit 1002 in the present embodiment may include an identification subunit 1002B, and a separation subunit 1002C.

The identification subunit 1002B is configured to identify the number of sound sources and position information of each sound source from the mixed sound signal according to the mixed sound signal and the set position information of each microphone.

The separation subunit 1002C is configured to separate out the object sound signal corresponding to each sound source from the mixed sound signal according to the mixed sound signal, the set position information of each microphone, the number of the sound sources and the position information of the sound sources.

It should be noted, the structure of the identification subunit 1002B and the separation subunit 1002C in the device embodiment shown in FIG. 12 may also be included in the device embodiment of FIG. 11, which is not restricted by the present disclosure.

Figure 13:
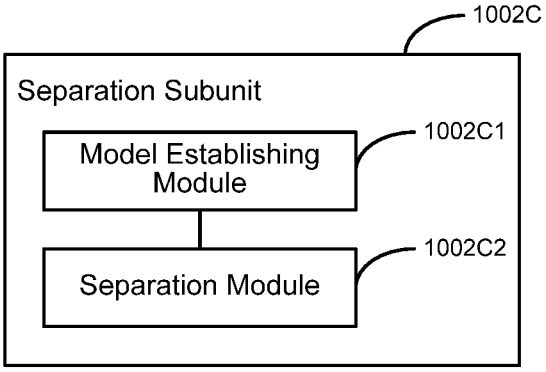

FIG. 13 is block diagram illustrating another device for recording an object audio, according to an exemplary embodiment. As shown in FIG. 13, on the basis of the embodiments shown in FIG. 12, the separation subunit 1002C in the present embodiment may include a model establishing module 1002C1 and a separation module 1002C2.

The model establishing module 1002C1 is configured to establish a corresponding statistical model according to a characteristic quantity formed by a sound signal emitted by each sound source in a preset dimension.

The separation module 1002C2 is configured to identify and separate out a sound signal conforming to the position information of any sound source in the mixed sound signal via the statistical model and use this sound signal as the object sound signal corresponding to the any sound source.

Figure 14:
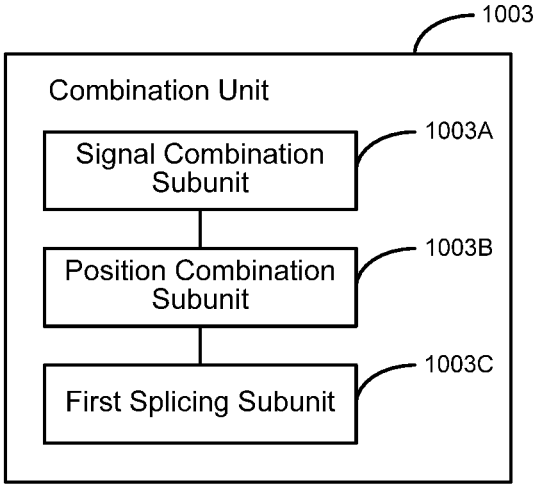

FIG. 14 is block diagram illustrating another device for recording an object audio, according to an exemplary embodiment. As shown in FIG. 14, on the basis of the embodiments shown in FIG. 10, the combination unit 1003 in the present embodiment may include: a signal combination subunit 1003A, a position combination subunit 1003B, and a first splicing subunit 1003C.

The signal combination subunit 1003A is configured to combine corresponding object sound signals according to an arrangement order of individual sound sources so as to obtain multi-object audio data.

The position combination subunit 1003B is configured to combine the position information of individual sound sources according to the arrangement order so as to obtain object audio auxiliary data.

The first splicing subunit 1003C is configured to splice header file information containing a preset parameter, the multi-object audio data and the object audio auxiliary data in turn so as to obtain the audio data in the object audio format.

It should be noted that the structure of the signal combination subunit 1003A, the position combination subunit 1003B, and the first splicing subunit 1003C in the device embodiment shown in FIG. 14 may also be included in the device embodiments of FIGS. 11-13, which is not restricted by the present disclosure.

Figure 15:
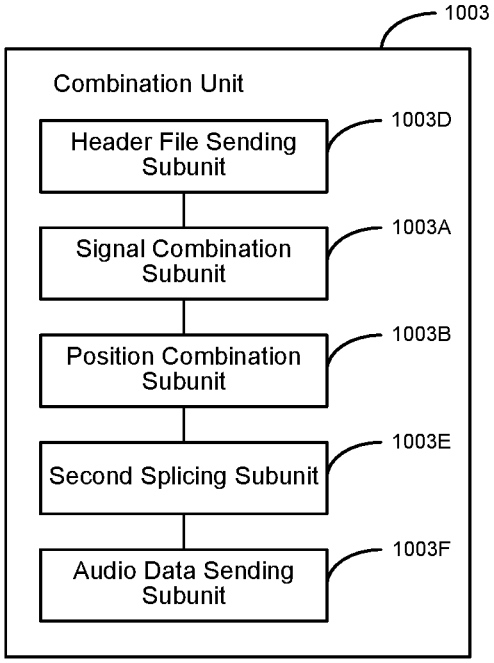

FIG. 15 is block diagram illustrating another device for recording an object audio, according to an exemplary embodiment. As shown in FIG. 15, on the basis of the embodiments shown in FIG. 10, the combination unit 1003 in the present embodiment may include: a header file sending subunit 1003D, a signal combination subunit 1003A, a position combination subunit 1003B, a second splicing subunit 1003E, and an audio data sending subunit 1003F.

The header file sending subunit 1003D is configured to generate header file information containing a preset parameter and send it to a preset audio process apparatus, wherein the header file information may include a time length of each frame of audio data, such that the signal combination subunit, the position combination subunit and the second splicing subunit generate each frame of audio data in object audio format conforming to the time length of each frame of audio data.

The signal combination subunit 1003A is configured to combine corresponding object audio signals according to an arrangement order of individual sound sources so as to obtain multi-object audio data.

The position combination subunit 1003B is configured to combine the position information of individual sound sources according to the arrangement order so as to obtain object audio auxiliary data.

The second splicing subunit 1003E is configured to splice the multi-object audio data and the object audio auxiliary data in turn so as to obtain each frame of audio data in the object audio format.

The audio data sending subunit 1003F is configured to send each frame of audio data in object audio format to the preset audio processing apparatus.

It should be noted that the structure of the header file sending subunit 1003D, the signal combination subunit 1003A, the position combination subunit 1003B, the second splicing subunit 1003E, and the audio data sending subunit 1003F in the device embodiment shown in FIG. 14 may also be included in the device embodiments of FIGS. 11-13, which is not restricted by the present disclosure.

Figure 16:
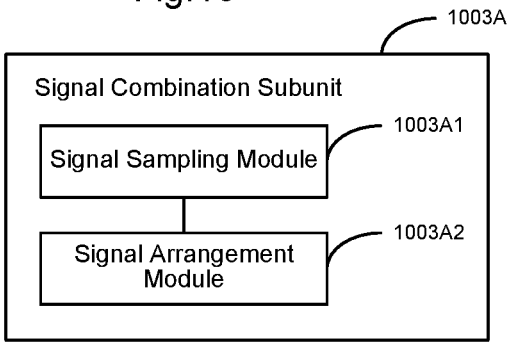

FIG. 16 is block diagram illustrating another device for recording an object audio, according to an exemplary embodiment. As shown in FIG. 16, on the basis of the embodiments shown in FIG. 14 or FIG. 15, the signal combination subunit 1003A in the present embodiment may include: a signal sampling module 1003A1 and a signal arrangement module 1003A2.

The signal sampling module 1003A1 is configured to sample the object sound signals corresponding to individual sound sources at each sampling time point respectively according to a preset sampling frequency, and arrange all the sampled signals according to the arrangement order, so as to obtain a combined sampled signal.

The signal arrangement module 1003A2 is configured to arrange the combined sampled signals obtained at each sampling time point in turn according to the sampling order, so as to obtain the multi-object audio data.

Figure 17:
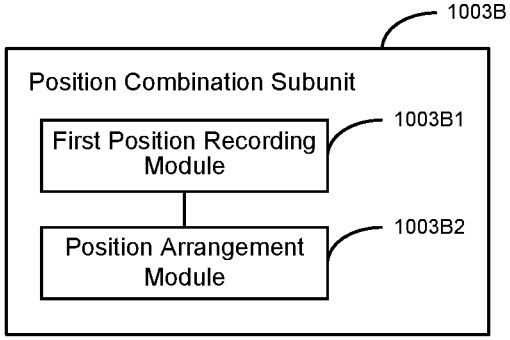

FIG. 17 is block diagram illustrating another device for recording an object audio, according to an exemplary embodiment. As shown in FIG. 17, on the basis of the embodiments shown in FIG. 14 or FIG. 15, the position combination subunit 1003B in the present embodiment may include: a first position recording module 1003B1 and a position arrangement module 1003B2.

The first position recording module 1003B1 is configured to sample position information corresponding to individual sound sources at each sampling time point respectively according to a preset sampling frequency, and record each sampled position information in association with corresponding sound source information and sampling time point information, so as to obtain combined sampled position information.

The position arrangement module 1003B2 is configured to arrange the combined sampled position information obtained at each sampling time point in turn according to the sampling order, so as to obtain the object auxiliary audio data.

Figure 18:
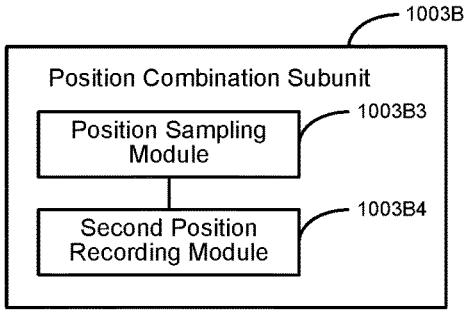

FIG. 18 is block diagram illustrating another device for recording an object audio, according to an exemplary embodiment. As shown in FIG. 18, on the basis of the embodiments shown in FIG. 14 or FIG. 15, the position combination subunit 1003B in the present embodiment may include: a position sampling module 1003B3, and a second position recording module 1003B4.

The position sampling module 1003B3 is configured to sample position information corresponding to individual sound sources respectively according to a preset sampling frequency.

The second position recording module 1003B4 is configured to, if a current sampling point is a first sampling time point, the obtained each sampled position information is recorded in association with corresponding sound source information and sampling time point information; and if the current sampling point is not the first sampling time point, the obtained sampled position information of each sound source is compared with previous sampled position information of the same sound source which has been recorded, and when determining that they are different via the comparison, the sampled position information is recorded in association with corresponding sound source information and sampling time point information.

With respect to the devices in the above embodiments, the specific manners for performing operations for individual modules therein have been described in detail in the embodiments regarding the methods, which will not be elaborated herein.

For device embodiments, since they are substantially corresponding to the method embodiments, the relevant contents may be referred to some explanations in the method embodiments. The above-described device embodiments are only illustrative. The units illustrated as separate components may be or may not be separated physically, the component used as a unit display may be or may not be a physical unit, i.e., may be located at one location, or may be distributed into multiple network units. A part or all of the modules may be selected to achieve the purpose of the solution in the present disclosure according to actual requirements. The person skilled in the art can understand and implement the present disclosure without paying inventive labor.

Correspondingly, the present disclosure further provides a device for achieving object audio recording, including: a processor; and a memory for storing instructions executable by the processor; wherein the processor is configured to: perform a sound collection operation via a plurality of microphones simultaneously so as to obtain a mixed sound signal; identify the number of sound sources and position information of each sound source and separate out an object sound signal corresponding to each sound source from the mixed sound signal according to the mixed sound signal and set position information of each microphone; and combine the position information and the object sound signals of individual sound sources to obtain audio data in an object audio format.

Correspondingly, the present disclosure also provides a terminal, the terminal may include: a memory; and one or more program, wherein the one or more programs is stored in the memory, and instructions for carrying out the following operations contained in the one or more programs are configured to be performed by one or more processor: perform a sound collection operation via a plurality of microphones simultaneously so as to obtain a mixed sound signal; identify the number of sound sources and position information of each sound source and separate out an object sound signal corresponding to each sound source from the mixed sound signal according to the mixed sound signal and set position information of each microphone; and combine the position information and the object sound signals of individual sound sources to obtain audio data in an object audio format.

Figure 19:
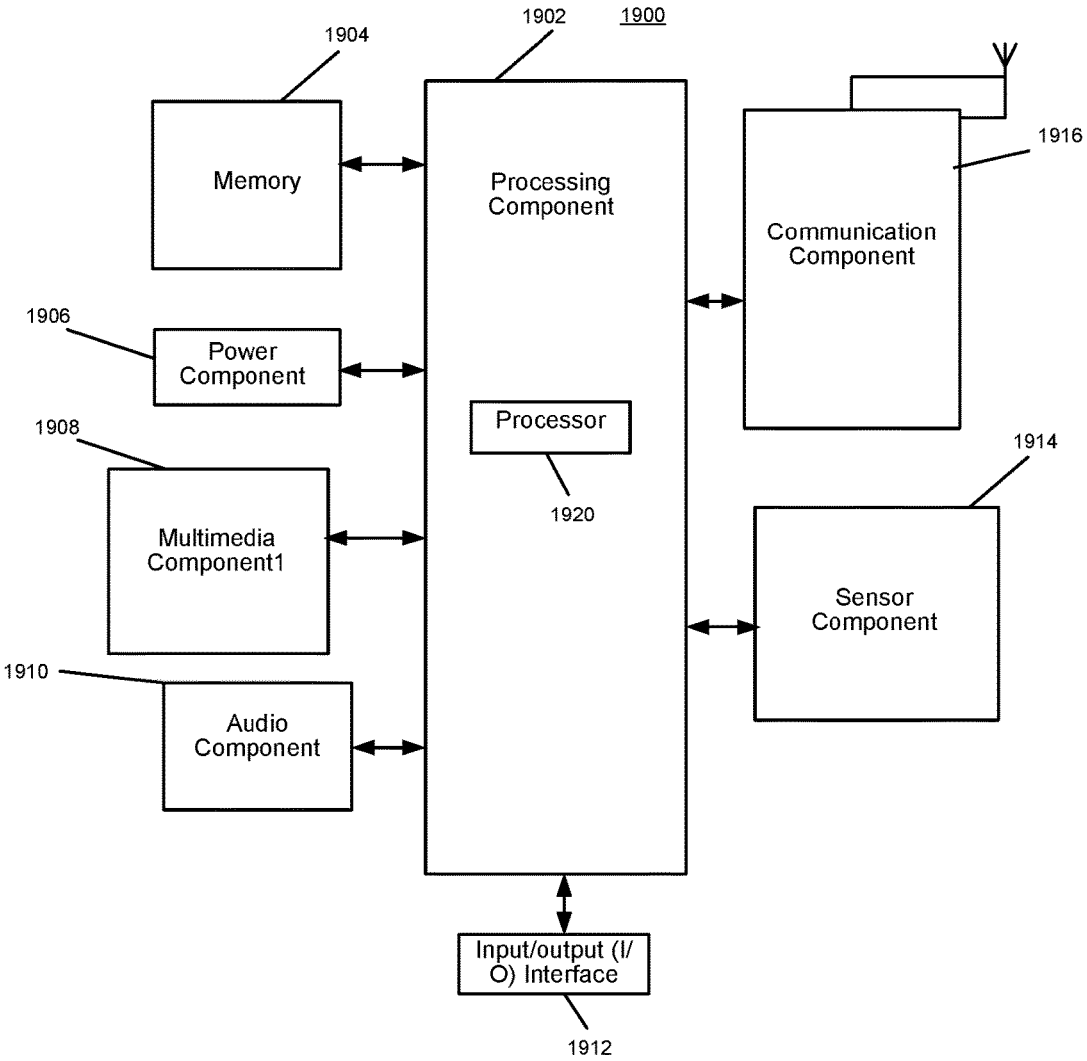
FIG. 19 is a structural block diagram illustrating a device for recording an object audio, according to an exemplary embodiment of the present disclosure.

FIG. 19 is a block diagram of a device 1900 for achieving object audio recording, according to an exemplary embodiment. For example, the device 1900 may be a mobile phone, a computer, a digital broadcast terminal, a messaging device, a gaming console, a tablet, a medical device, exercise equipment, a personal digital assistant, and the like.

Referring to FIG. 19, the device 1900 may include one or more of the following components: a processing component 1902, a memory 1904, a power component 1906, a multimedia component 1908, an audio component 1910, an input/output (I/O) interface 1912, a sensor component 1914, and a communication component 1916.

The processing component 1902 typically controls overall operations of the device 1900, such as the operations associated with display, telephone calls, data communications, camera operations, and recording operations. The processing component 1902 may include one or more processors 1920 to execute instructions to perform all or part of the steps in the above described methods. Moreover, the processing component 1902 may include one or more modules which facilitate the interaction between the processing component 1902 and other components. For instance, the processing component 1902 may include a multimedia module to facilitate the interaction between the multimedia component 1908 and the processing component 1902.

The memory 1904 is configured to store various types of data to support the operation of the device 1900. Examples of such data include instructions for any applications or methods operated on the device 1900, contact data, phonebook data, messages, pictures, video, etc. The memory 1904 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 1906 provides power to various components of the device 1900. The power component 1906 may include a power management system, one or more power sources, and any other components associated with the generation, management, and distribution of power in the device 1900.

The multimedia component 1908 may include a screen providing an output interface between the device 1900 and the user. In some embodiments, the screen may include a liquid crystal display (LCD) and a touch panel (TP). If the screen may include the touch panel, the screen may be implemented as a touch screen to receive input signals from the user. The touch panel may include one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1908 may include a front camera and/or a rear camera. The front camera and the rear camera may receive an external multimedia datum while the device 1900 is in an operation mode, such as a photographing mode or a video mode. Each of the front camera and the rear camera may be a fixed optical lens system or have focus and optical zoom capability.

The audio component 1910 is configured to output and/or input audio signals. For example, the audio component 1910 may include a microphone ("MIC") configured to receive an external audio signal when the device 1900 is in an operation mode, such as a call mode, a recording mode, and a voice recognition mode. The received audio signal may be further stored in the memory 1904 or transmitted via the communication component 1916. In some embodiments, the audio component 1910 further may include a speaker to output audio signals.

The I/O interface 1912 provides an interface between the processing component 1902 and peripheral interface modules, such as a keyboard, a click wheel, buttons, and the like. The buttons may include, but are not limited to, a home button, a volume button, a starting button, and a locking button.

The sensor component 1914 may include one or more sensors to provide status assessments of various aspects of the device 1900. For instance, the sensor component 1914 may detect an open/closed status of the device 1900, relative positioning of components, e.g., the display and the keypad, of the device 1900, a change in position of the device 1900 or a component of the device 1900, a presence or absence of user contact with the device 1900, an orientation or an acceleration/deceleration of the device 1900, and a change in temperature of the device 1900. The sensor component 1914 may include a proximity sensor configured to detect the presence of nearby objects without any physical contact. The sensor component 1914 may also include a light sensor, such as a CMOS or CCD image sensor, for use in imaging applications. In some embodiments, the sensor component 1914 may also include an accelerometer sensor, a gyroscope sensor, a magnetic sensor, a pressure sensor, or a temperature sensor.

The communication component 1916 is configured to facilitate communication, wired or wirelessly, between the device 1900 and other devices. The device 1900 can access a wireless network based on a communication standard, such as WiFi, 2G, or 3G, or a combination thereof. In one exemplary embodiment, the communication component 1916 receives a broadcast signal or broadcast associated information from an external broadcast management system via a broadcast channel. In one exemplary embodiment, the communication component 1916 further may include a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 1900 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer readable storage medium including instructions, such as included in the memory 1904, executable by the processor 1920 in the device 1900, for performing the above-described methods. For example, the non-transitory computer-readable storage medium may be a ROM, a RAM, a CD-ROM, a magnetic tape, a floppy disc, an optical data storage device, and the like.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

The invention claimed is:

1. A method for achieving object audio recording, comprising:

collecting, by an electronic device comprising a memory and a processor in communication with the memory, a mixed sound signal from a plurality of sound sources simultaneously via a plurality of microphones;

identifying, by the electronic device from the mixed sound signal according to position information of each microphone of the plurality of microphones, an identity and position information of each sound source of the plurality of sound sources;

for the each sound source of the plurality of sound sources, separating out, by the electronic device, an object sound signal corresponding to the each sound source according to the mixed sound signal, the position information of each microphone, a number of the plurality of sound sources, and the position information of the each sound source of the plurality of sound sources; and combining, by the electronic device, the position information and the object sound signal of each of the plurality of sound sources to obtain object audio data of the mixed sound signal in an object audio format.

2. The method of claim 1, wherein the identifying the each sound source of the plurality of sound sources and the position information of the each sound source comprises:

identifying, by the electronic device, an identity of the each sound source and the position information of the each sound source according to an amplitude difference and a phase difference of a sound from the each sound source and detected by the plurality of microphones.

3. The method of claim 1, wherein, for each sound source of the plurality of sound sources, the separating out of the object sound signal corresponding to the each sound source comprises:

establishing, by the electronic device, a corresponding statistical model according to a characteristic quantity formed by a sound signal emitted by the each sound source in a preset dimension; and from the mixed sound signal, identifying and separating out, by the electronic device, a sound signal conforming to the position information of the each sound source via the statistical model as the object sound signal corresponding to the each sound source.

4. The method of claim 1, wherein the combining the position information and the object sound signal of the each sound source of the plurality of sound sources to obtain the object audio data of the mixed sound signal in the object audio format comprises:

obtaining, by the electronic device, multi-object audio data by combining corresponding object sound signals according to an arrangement order of individual sound sources;

obtaining, by the electronic device, object audio auxiliary data by combining the position information of individual sound sources according to the arrangement order; and obtaining, by the electronic device, the object audio data in the object audio format by in turn splicing header file information containing a preset parameter, the multi-object audio data, and the object audio auxiliary data.

5. The method of claim 1, wherein the combining the position information and the object sound signal of the each sound source of the plurality of sound sources to obtain the object audio data of the mixed sound signal in the object audio format comprises:

generating, by the electronic device, header file information comprising a time length of each frame of audio data;

sending, by the electronic device, the header file information to a preset audio process apparatus; and generating, by the electronic device, each frame of audio data in the object audio format conforming to the time length of each frame of audio data by:

obtaining, by the electronic device, multi-object audio data by combining corresponding object audio signals according to an arrangement order of individual sound sources;

obtaining, by the electronic device, object audio auxiliary data by combining the position information of individual sound sources according to the arrangement order; and obtaining, by the electronic device, each frame of audio data in the object audio format by in turn splicing the multi-object audio data and the object audio auxiliary data; and sending, by the electronic device, each frame of the audio data in the object audio format to the preset audio process apparatus to obtain the object audio data of the mixed sound signal in the object audio format.

6. The method of claim 5, wherein the obtaining the multi-object audio data by combining the corresponding object audio signals comprises:

sampling, by the electronic device, the object sound signals corresponding to individual sound sources at each sampling time point respectively according to a preset sampling frequency, and arranging all the sampled signals according to the arrangement order, so as to obtain a combined sampled signal; and arranging, by the electronic device, the combined sampled signals obtained at each sampling time point in turn according to the sampling order, so as to obtain the multi-object audio data.

7. The method of claim 5, wherein the obtaining the object audio auxiliary data by combining the position information of individual sound sources comprises:

sampling, by the electronic device, position information corresponding to individual sound sources at each sampling time point respectively according to a preset sampling frequency, and recording each sampled position information in association with corresponding sound source information and sampling time point information, so as to obtain combined sampled position information; and arranging, by the electronic device, the combined sampled position information obtained at each sampling time point in turn according to the sampling order, so as to obtain the object auxiliary audio data.

8. The method of claim 5, wherein the obtaining the object audio auxiliary data by combining the position information of individual sound sources comprises:

sampling, by the electronic device, position information corresponding to individual sound sources respectively according to a preset sampling frequency;

wherein:

when a current sampling point is a first sampling time point, the obtained each sampled position information is recorded in association with corresponding sound source information and sampling time point information; and when the current sampling point is not the first sampling time point, the obtained sampled position information of each sound source is compared with previous sampled position information of the same sound source which has been recorded, and when determining that they are different via the comparison, the sampled position information is recorded in association with corresponding sound source information and sampling time point information.

9. An electronic device, comprising:

a memory for storing instructions; and a processor in communication with the memory, wherein when executing the instructions, the processor is configured to:

collect a mixed sound signal from a plurality of sound sources simultaneously via a plurality of microphones;

identify, from the mixed sound signal, an identify and position information of each sound source of the plurality of sound sources according to position information of each microphone of the plurality of microphones;

for the each sound source of the plurality of sound sources, separate out an object sound signal corresponding to the each sound source from the mixed sound signal according to the mixed sound signal, the position information of each microphone, a number of the plurality of the sound sources, and the position information of the each sound source; and combine the position information and the object sound signal of each of the plurality of sound sources to obtain object audio data of the mixed sound signal in an object audio format.

10. The device of claim 9, wherein, when the processor is configured to identify the each sound source from the plurality of sound sources and the position information of the each sound source, the processor is configured to:

identify an identity and the position information of the each sound source according to an amplitude difference and a phase difference of a sound from the each sound source and detected by the plurality of microphones.

11. The device of claim 9, wherein, when the processor is configured to separate the object sound signal corresponding to the each sound source, the processor is configured to:

establish a corresponding statistical model according to a characteristic quantity formed by a sound signal emitted by the each sound source in a preset dimension; and from the mixed sound signal, identify and separate out a sound signal conforming to the position information of the each sound source via the statistical model as the object sound signal corresponding to the each sound source.

12. The device of claim 9, wherein, when the processor is configured to combine the position information and the object sound signal of the each sound source of the plurality of sound sources to obtain the object audio data of the mixed sound signal in the object audio format, the processor is further configured to:

obtain multi-object audio data by combining corresponding object sound signals according to an arrangement order of individual sound sources;

obtain object audio auxiliary data by combining the position information of individual sound sources according to the arrangement order; and obtain the object audio data in the object audio format by in turn splicing header file information containing a preset parameter, the multi-object audio data and the object audio auxiliary data.

13. The device of claim 9, wherein, when the processor is configured to combine the position information and the object sound signal of the each sound source of the plurality of sound sources to obtain the object audio data of the mixed sound signal in the object audio format, the processor is configured to:

generate header file information comprising a time length of each frame of audio data;

send the header file information to a preset audio process apparatus;

generate each frame of audio data in object audio format conforming to the time length of each frame of audio data by:

obtaining multi-object audio data by combining corresponding object audio signals according to an arrangement order of individual sound sources so as to obtain multi-object audio data;

obtaining object audio auxiliary data by combining the position information of individual sound sources according to the arrangement order so as to obtain object audio auxiliary data;

obtaining each frame of audio data in the object audio format by in turn splicing the multi-object audio data and the object audio auxiliary data in turn so as to obtain each frame of audio data in the object audio format; and send each frame of audio data in object audio format to the preset audio processing apparatus to obtain the object audio data of the mixed sound signal in the object audio format.

14. The device of claim 13, wherein, when the processor is configured to combine the corresponding object audio signals, the processor is configured to:

sample the object sound signals corresponding to individual sound sources at each sampling time point respectively according to a preset sampling frequency, and arrange all the sampled signals according to the arrangement order, so as to obtain a combined sampled signal; and arrange the combined sampled signals obtained at each sampling time point in turn according to the sampling order, so as to obtain the multi-object audio data.

15. The device of claim 13, wherein, when the processor is configured to combine the position information of individual sound sources, the processor is configured to:

sample position information corresponding to individual sound sources at each sampling time point respectively according to a preset sampling frequency, and record each sampled position information in association with corresponding sound source information and sampling time point information, so as to obtain combined sampled position information; and arrange the combined sampled position information obtained at each sampling time point in turn according to the sampling order, so as to obtain the object auxiliary audio data.

16. The device of claim 13, wherein, when the processor is configured to combine the position information of individual sound sources, the processor is configured to:

sample position information corresponding to individual sound sources respectively according to a preset sampling frequency;

wherein:

when a current sampling point is a first sampling time point, the obtained each sampled position information is recorded in association with corresponding sound source information and sampling time point information; and when the current sampling point is not the first sampling time point, the obtained sampled position information of each sound source is compared with previous sampled position information of the same sound source which has been recorded, and when determining that they are different via the comparison, the sampled position information is recorded in association with corresponding sound source information and sampling time point information.

17. A non-transitory readable storage medium comprising instructions, executable by a processor in an electronic apparatus, for achieving object audio recording, wherein when executed by the processor, the instructions direct the electronic apparatus to perform acts of:

collecting a mixed sound signal from a plurality of sound sources simultaneously via a plurality of microphones;

identifying, from the mixed sound signal according to position information of each microphone of the plurality of microphones, an identity and position information of each sound source of the plurality of sound sources;

for the each sound source of the plurality of sound sources, separating out an object sound signal corresponding to the each sound source according to the mixed sound signal, the position information of each microphone, a number of the plurality of sound sources, and the position information of the each sound source of the plurality of sound sources; and combining the position information and the object sound signal of each of the plurality of sound sources to obtain object audio data of the mixed sound signal in an object audio format.

* * * * *